US011525443B1

(12) United States Patent
Wang et al.

(10) Patent No.: US 11,525,443 B1
(45) Date of Patent: Dec. 13, 2022

(54) FULL-METAL ANTI-HIGH TEMPERATURE CYCLOID DOWNHOLE MOTOR

(71) Applicant: CHINA UNIVERSITY OF GEOSCIENCES (BEIJING), Beijing (CN)

(72) Inventors: Yu Wang, Beijing (CN); Jiaxing Lu, Beijing (CN); Lingrong Kong, Beijing (CN); Kai Zhang, Beijing (CN); Zhiqiao Wang, Beijing (CN)

(73) Assignee: CHINA UNIVERSITY OF GEOSCIENCES (BEIJING), Beijing (CN)

( * ) Notice: Subject to any disclaimer, the term of this patent is extended or adjusted under 35 U.S.C. 154(b) by 34 days.

(21) Appl. No.: 17/364,936

(22) Filed: Jul. 1, 2021

(30) Foreign Application Priority Data

Jun. 8, 2021 (CN) ..... 202110640555.2

(51) Int. Cl.

| | |
|---|---|
| ***F03C 2/00*** | (2006.01) |
| ***F03C 4/00*** | (2006.01) |
| ***F04C 18/00*** | (2006.01) |
| ***F04C 2/00*** | (2006.01) |
| ***F04C 2/107*** | (2006.01) |

(Continued)

(52) U.S. Cl.
CPC ..... *F04C 2/1073* (2013.01); *E21B 4/02* (2013.01); *F01C 21/18* (2013.01); *F04C 15/0019* (2013.01)

(58) Field of Classification Search
CPC ..... F04C 2/104; F04C 2/105; F04C 2/1073; F01C 15/0019; F01C 21/18; F03C 2/08; F03C 2/22; F03C 2/304; E21B 4/02
See application file for complete search history.

(56) References Cited

U.S. PATENT DOCUMENTS 3,723,032 A * 3/1973 Woodling ..... F04C 2/104 418/61.3
4,139,335 A * 2/1979 Wusthof ..... F04C 2/104 418/61.3

(Continued)

FOREIGN PATENT DOCUMENTS

CN 205089524 U 3/2016
CN 109505728 A * 3/2019 ..... E21B 4/02

(Continued)

OTHER PUBLICATIONS

CN109505728A—Huang L. et al.—Dynamic Push Type Rotary Motor—Mar. 22, 2019—The English Machine Translation. (Year: 2019).*

(Continued)

*Primary Examiner* — Theresa Trieu

(57) ABSTRACT

A full-metal anti-high temperature cycloid downhole motor comprises an outer tube, a stator, a rotor, a partition plate, a flow distribution disc, and a flow guide mechanism. The inside of the stator is provided with N grooves, the inner side walls of the N grooves form an annular inner contour surface; the rotor is formed with N−1 rotating heads provided along the axial direction of the outer tube, and each rotating head is provided with an embedding slot, one side of the embedding slot is provided with a notch, a rotor copper rod that can be in rolling engagement with the inner contour surface through the notch is provided in the embedding slot, and there is a changing gap between the outer wall of the rotor copper rod and the inner wall of the embedding slot.

9 Claims, 15 Drawing Sheets

(51) Int. Cl.

| | |
|---|---|
| ***F01C 21/18*** | (2006.01) |
| ***E21B 4/02*** | (2006.01) |
| ***F04C 15/00*** | (2006.01) |

(56) References Cited

U.S. PATENT DOCUMENTS

| | | | | |
|---|---|---|---|---|
| 4,264,288 | A * | 4/1981 | Wusthof | F04C 2/105 418/61.3 |
| 2004/0052667 | A1 | 3/2004 | Dong | |
| 2015/0068811 | A1* | 3/2015 | Marchand | E21B 4/02 175/107 |

FOREIGN PATENT DOCUMENTS

| | | | | |
|---|---|---|---|---|
| CN | 210829061 U | * | 6/2020 | E21B 4/02 |
| CN | 113389681 A | * | 9/2021 | E21B 4/02 |

OTHER PUBLICATIONS

CN210829061U—Chang T et al.—Based On All-metal Underground Power Drilling Multi-stage Plunger-of Eccentric Gear Mechanism—Jun. 23, 2020—The English Machine Translation. (Year: 2020).*

CN113389681A—Kong L. et al.—All-Metal Movable Sealing Concentric Centring Underground Volume Motor—Sep. 14, 2021—The English Machine Translation. (Year: 2021).*

* cited by examiner

A

FULL-METAL ANTI-HIGH TEMPERATURE CYCLOID DOWNHOLE MOTOR

CROSS-REFERENCE TO RELATED APPLICATION

The present application is based on and claims the priority benefits of China application No. 202110640555.2, filed on Jun. 8, 2021. The entirety of the above-mentioned patent application is hereby incorporated by reference herein and made a part of this specification.

BACKGROUND

Technical Field

The present application relates to a downhole motor, in particular to a full-metal anti-high temperature cycloid downhole motor driven by a high temperature drilling fluid.

Description of Related Art

Downhole motors are also called positive displacement motors. At present, downhole motors with mechanical characteristic such as "hard" are only screw motors, which are widely used in the drilling industry. However, screw motors also have the following problems during actual use: (1) a stator in the conventional screw motor is made of rubber and cannot be used under high temperature conditions, fore example the downhole temperature is ≥180° C.; (2) a full-metal screw replaces the rubber stator with a metal stator, but the current processing level cannot guarantee the processing accuracy; (3) the screw motor is used for spiral distribution, and for the helix, the lead must be 2-3 times the conventional lead to achieve the flow distribution driving effect, which causes that the screw motor is generally too long; (4) the screw motor has an interference fit between the stator and the rotor, the drilling fluid containing impurities during downhole drilling can easily cause jam and abrasion between the stator and rotor, reducing the service life of the motor.

Regarding the above-mentioned related technologies, the traditional downhole motor has the defects of being easy to jam, easy to wear and not resistant to high temperature during downhole drilling.

SUMMARY

In order to improve the problems of being easy to jam, easy to wear and not resistant to high temperature between a stator and a rotor, the present application provides a full-metal anti-high temperature cycloid downhole motor.

The full-metal anti-high temperature cycloid downhole motor provided in the present application adopts the following technical solutions.

A full-metal anti-high temperature cycloid downhole motor comprises an outer tube, a stator fixedly mounted in the outer tube, a rotor provided in the stator and having the same height as the stator, a partition plate and a flow distribution disc respectively fixed to two ends of the stator, and a flow guide mechanism located at a side of the flow distribution disc away from the stator, and the flow guide mechanism cooperates with the flow distribution disc to perform a flow distribution to drive the rotor to rotate in the stator;

the inside of the stator is provided with N grooves distributed equidistantly on the circumference and extending through the stator along the axial direction of the outer tube, the inner side walls of the N grooves are connected end to end to form an annular inner contour surface, wherein N is a natural number greater than 1;

the rotor is formed with N−1 rotating heads provided along the axial direction of the outer tube, a working chamber is formed among the adjacent rotating heads and the inner contour surface, the partition plate and the flow distribution disc, and each rotating head is provided with an embedding slot that extends through the rotating head along the axial direction of the outer tube, one side of the embedding slot is provided with a notch of the same length as the embedding slot, a rotor copper rod that can be in rolling engagement with the inner contour surface through the notch is provided in the embedding slot, and there is a changing gap between the outer wall of the rotor copper rod and the inner wall of the embedding slot.

By adopting the above technical solution, during the rotation of the rotor, the rotor copper rod partially protrudes from the notch under the centrifugal action and is in rolling engagement with the inner contour surface, so that the traditional sliding friction between the rotor and the stator is converted into rolling friction, which greatly reduces friction resistance, reduces wear and kinetic energy loss, and improves service life. At the same time, when the liquid contains impurities, the rotor copper rod can be retracted into the embedding slot under the action of squeezing force, so that the impurities can pass through, which solves the traditional downhole problem such as jamming or wearing. The whole is processed by full-metal materials, so that the downhole motor has the characteristics of high temperature resistance.

Preferably, a stator copper rod in rolling contact with the rotor is rotatably embedded in a position of the stator between adjacent grooves.

By adopting the above technical solution, it is mainly used to further reduce the wear between the stator and the rotor and increase the service life.

Preferably, the outer side wall of the stator is attached to the inner side wall of the outer tube, and at least one flow passage extending axially along the outer tube and communicating with the flow guide mechanism is provided on the outer side wall of the stator; a second relief slot is provided at the position of the partition plate corresponding to the flow passage, a third relief slot is provided at the position of the flow distribution disc corresponding to the flow passage.

By adopting the above technical solution, multiple flow passages can be provided according to needs to increase the inlet flow rate and increase the displacement of the downhole motor.

Preferably, a water diversion cover plate is fixed on the side of the partition plate away from the stator, a first relief slot is provided at the position of the water diversion cover plate corresponding to the flow passage; a cone is integrally formed on the water diversion cover plate, the bottom surface of the cone is smaller than that of the water diversion cover plate, and the apex of the cone faces the water inlet end.

By adopting the above technical solution, when the high-pressure liquid is injected from the joint, the arrangement of the cone can greatly reduce the resistance of the high-pressure liquid, so as to quickly enter the flow guide mechanism.

Preferably, the flow guide mechanism comprises a flow distribution cylinder provided within the outer tube and communicated with the flow distribution disc, and a flow distribution shaft rotatably connected within the flow distribution cylinder to communicate the flow passage with the flow distribution cylinder, and the flow distribution shaft is gaplessly and rotatably fitted with the flow distribution cylinder;

a cardan shaft for transmission is provided between the flow distribution shaft and the rotor, a spline is provided on the outer side wall of the cardan shaft, and the opposite ends of the flow distribution shaft and the rotor is provided with a spline slot that can cooperate with the spline.

By adopting the above technical solution, during the rotation of the rotor, the cardan shaft drives the flow distribution shaft to rotate synchronously, thereby outputting power outward.

Preferably, the flow distribution shaft is rotatably supported within the flow distribution cylinder through a bearing.

By adopting the above technical scheme, it is mainly used to correct the flow distribution shaft to ensure the stable output of the flow distribution shaft.

Preferably, the outer side wall of the flow distribution shaft is provided with a first ring slot and a second ring slot, the second ring slot is provided with a liquid discharge port radially extending through the flow distribution shaft, and the end of the flow distribution shaft away from the spline slot is provided inwardly with a liquid discharge chamber communicating with the liquid discharge port;

a flow distribution ring is formed between the first ring slot and the second ring slot, and the flow distribution ring is provided with a plurality of liquid inlet slots and liquid outlet slots that are equidistantly distributed on a circumference and provided at intervals; the liquid inlet slot is communicated with the first ring slot, and the liquid outlet slot is communicated with the second ring slot;

a fourth relief slot communicating with the first ring slot is provided at the position of the flow distribution cylinder corresponding to the third relief slot, a plurality of liquid inlet channels and liquid outlet channels that are equidistantly distributed on a circumference and provided at intervals are provided inwardly from an end of the flow distribution cylinder close to the flow distribution disc along the axial direction, and the liquid inlet channel is communicated with the liquid inlet slot, and the liquid outlet channel is communicated with the liquid outlet slot;

the flow distribution disc is provided with a liquid inlet that is communicated with any liquid inlet channel to supply liquid to the corresponding working chamber, and a liquid outlet that is communicated with any liquid outlet channel to discharge the liquid in the corresponding working chamber, and the liquid inlet and the liquid outlet correspond to different working chambers.

By adopting the above technical solution, after the high-pressure liquid is injected from the joint, it enters the first ring slot sequentially through the first relief slot, the second relief slot, the flow passage, the third relief slot and the fourth relief slot. The inner wall of the flow distribution shaft matches the outer wall of the flow distribution cylinder, so the high-pressure liquid can only flow into the three liquid inlet slots, and then is injected into the high-pressure chamber through the liquid inlet slot communicated with the liquid inlet on the flow distribution disc so as to drive the rotor to rotate in the direction of the low-pressure chamber; while the high-pressure liquid in the other two liquid inlet slots impacts on the flow distribution disc, exerting an upward supporting force on the flow distribution disc, thereby offsetting part of the impact force at the water injection end so as to reduce the axial force on the bearing and increase the service life of the downhole motor.

Preferably, the end of the outer tube away from the partition plate is provided with a base for supporting the flow distribution cylinder, the end of the flow distribution shaft away from the spline slot extends through the base and to the outside of the outer tube, and the end of the outer tube close to the partition plate is provided with a joint to press the stator against the flow distribution cylinder.

By adopting the above technical solution, the arrangement of the base and the joint is used to press and fix the water diversion cover plate, the baffle plate, the stator, the rotor, the flow distribution disc and the flow guide mechanism within the outer pipe, and it is convenient to replace any of the above components according to needs, which improves the service life of the downhole motor.

Preferably, the joint comprises an assembly section and a connecting section that are integrally formed, and an assembly section presses the stator against the flow guide mechanism by being fixedly connected with the inner wall of the outer tube; and the inner wall of the connecting section is provided with internal threads.

By adopting the above technical solution, the arrangement of the internal thread facilitates the connection of a high-pressure water circuit.

In summary, the present application comprises at least one of the following beneficial technical effects.

1. In the present application, the rotor copper rod is provided on the rotor, so that traditional sliding friction between the rotor and the stator is converted into rolling friction, which greatly reduces friction resistance, reduces wear and kinetic energy loss, and improves service life. At the same time, when the liquid contains impurities, the rotor copper rod can be retracted into the embedding slot under the action of squeezing force, so that the impurities can pass through, which solves the traditional downhole problem that the motor is easy to jam and wear. The whole is processed by full-metal materials, so that the downhole motor has the characteristics of high temperature resistance.

2. By making the high pressure liquid in at least two liquid inlet slots impact on the flow distribution disc, the flow distribution disc can get an upward supporting force, thereby offsetting part of the impact force at the water injection end, reducing the axial force acting on the bearing, and improving the service life of the downhole motor;

3. By increasing the inlet flow of the flow guide mechanism, the output torque of the downhole motor is greatly improved.

DESCRIPTION OF REFERENCE SIGNS

1. Outer tube; 2. Joint; 21. Assembly section; 22. Connecting section; 3. Support ring; 4. Water diversion cover plate; 41. Cone; 42, first relief slot; 5. Partition plate; 51. Second relief slot; 6. Stator; 61. Flow passage; 62. Groove; 63. Inner contour surface; 64. Stator copper rod; 7. Flow distribution disc; 71. Third relief slot 72. Liquid inlet; 73. Liquid outlet; 8. Base; 9. Rotor; 91. Rotating head; 92. Embedding slot; 93. Rotor copper rod; 10. Flow distribution cylinder; 101. Fourth relief slot; 102. Liquid inlet channel; 103. Liquid outlet channel; 20. Flow distribution shaft; 201. First ring slot; 202. Second ring slot; 203. Liquid discharge port; 204. Liquid discharge chamber; 205. Flow distribution ring; 206. Liquid inlet slot; 207. Liquid outlet slot; 30. Cardan shaft; 40 Bearing.

DESCRIPTION OF THE EMBODIMENTS

The present application will be further described in detail below in conjunction with attached FIGS. 1-15.

Figure 1:
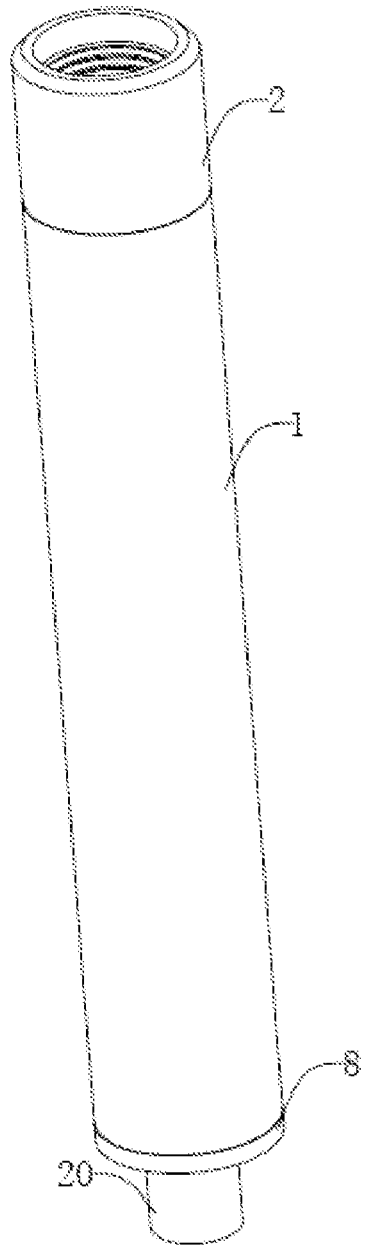
FIG. 1 is a schematic diagram of the overall structure of a novel cycloid full-metal downhole motor in an embodiment of the present application.
Figure 2:
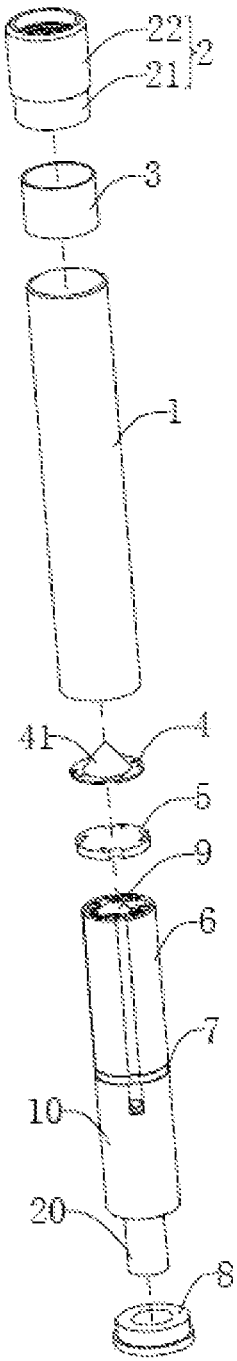
FIG. 2 is an exploded schematic diagram showing various components in the novel cycloid full-metal downhole motor.

The embodiment of the present application discloses a full-metal anti-high temperature cycloid downhole motor. Referring to FIGS. 1 and 2, the full-metal anti-high temperature cycloid downhole motor comprises an outer tube 1, a joint 2 and a base 8. The joint 2 is threadedly connected to one end of the outer tube 1, and the base 8 is threadedly connected to the other end of the outer tube 1. In this embodiment, the end connected to the joint 2 is defined as the upper end of the outer tube 1, and the end connected to the base 8 is defined as the lower end of the outer tube 1. A support ring 3, a water diversion cover plate 4, a partition plate 5, a stator 6, a flow distribution disc 7 and a flow guide mechanism are provided in the outer tube 1 from top to bottom. The joint 2 on the one hand is used to cooperate with the base 8 to press and fix the support ring 3, the water diversion cover plate 4, the partition plate 5, the stator 6, the flow distribution disc 7, and the flow guide mechanism within the outer tube 1, and on the other hand is used to connect a high-pressure water circuit. The stator 6 is hollow in the inside and has an opening at two ends. A rotor 9 with the same height as the stator is provided within the stator. The partition plate 5 and the flow distribution disc 7 are respectively fixed on the two ends of the stator 6 and are mainly used to separate the stator 6 and the rotor 9 from other structures. The flow guide mechanism is mainly used to cooperate with the flow distribution disc 7 to perform flow distribution so as to drive the rotor 9 to rotate in the stator 6 so as to output power to the outside.

Figure 3:
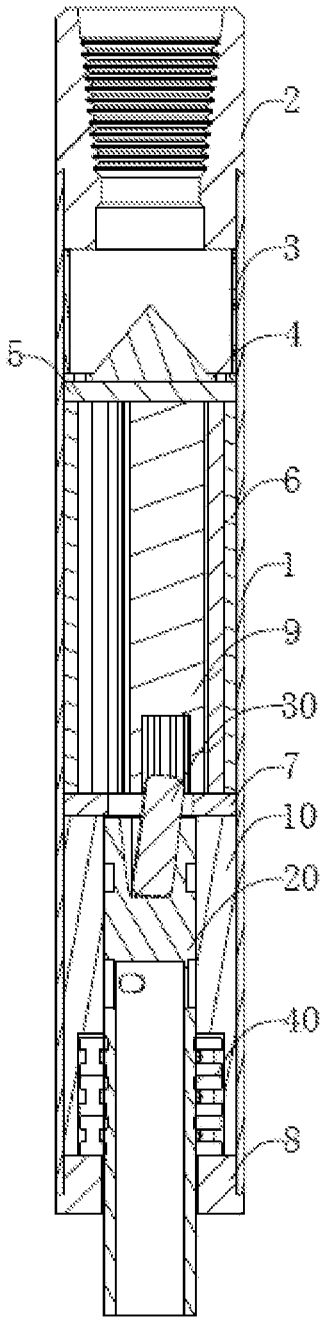
FIG. 3 is a cross-sectional view showing the internal structure of the novel cycloid full-metal downhole motor.

Referring to FIGS. 2 and 3, the joint 2 is hollow in the inside and has an opening at two ends. It specifically comprises an assembly section 21 and a connection section 22 that are integrally formed. The assembly section 21 extends into the outer tube 1 and is threadedly connected with the inner wall of the outer tube 1. The end of the assembly section 21 extending into the outer tube 1 abuts against the support ring 3 inside the outer tube 1. When assembling, a pre-tightening force is applied to the support ring 3 through the threaded fit between the assembly section 21 and the outer tube 1, so as to realize the tight abutment of the support ring 3 to the water diversion cover plate 4. The inner wall of the connecting section 22 is provided with internal threads for connecting with the high-pressure water circuit.

Figure 4:
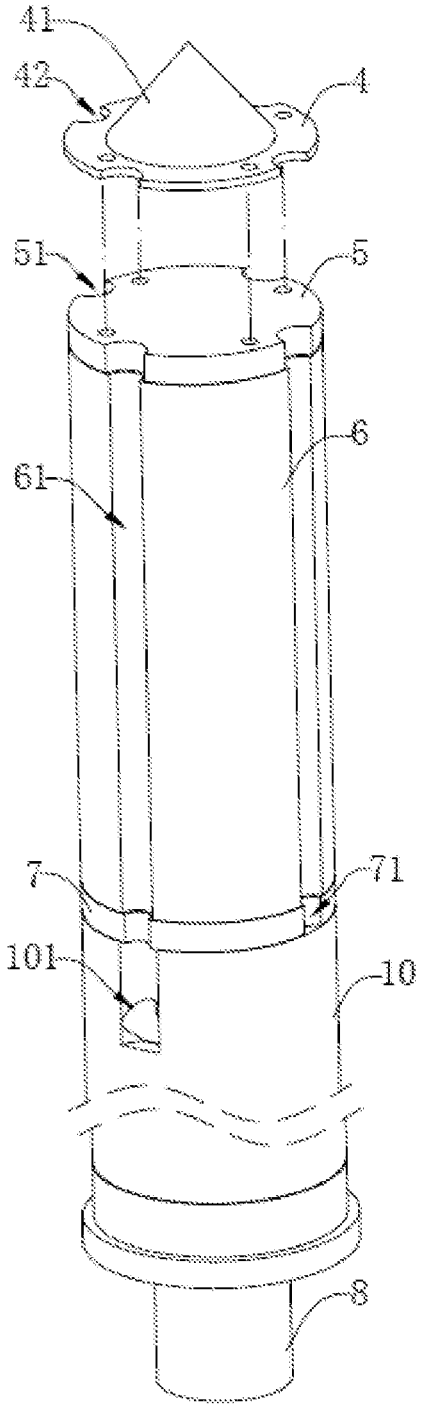
FIG. 4 is an exploded schematic diagram showing a matching relationship among a water diversion cover plate, a partition plate, a stator, a flow distribution disc and a flow distribution cylinder.

Referring to FIGS. 3 and 4, the water diversion cover plate 4 is fixed to the partition plate 5 by screws. The side of the water diversion cover plate 4 away from the partition plate 5 is integrally formed with a cone 41. The bottom surface of the cone 41 is smaller than the water diversion cover plate 4, and the apex of the cone 41 faces the joint 2. When the high-pressure liquid is injected from the joint 2, the cone 41 can form a flow guiding surface for guiding the high-pressure liquid, so as to make it quickly enter the flow guide mechanism.

The outer side wall of the stator 6 and the inner side wall of the outer tube 1 are in a fixed assembly relationship. The outer side wall of the stator 6 is provided with a plurality of flow passages 61 extending axially along the outer tube 1 and communicating with the flow guide mechanism. The water diversion cover plate 4 is provided with a first relief slot 42 at the position corresponding to the flow passage 61, the partition plate 5 is provided with a second relief slot 51 at the position corresponding to the flow passage 61, and the flow distribution disc 7 is provided with a third relief slot at the position corresponding to the flow passage 61. The high-pressure liquid injected by the joint 2 enters the flow guide mechanism sequentially through the first relief slot 42, the second relief slot 51, the flow passage 61, and the third relief slot 71. The arrangement of the plurality of flow passages 61 greatly increases the inlet flow of the flow guide mechanism and enables the downhole motor to output a greater torque.

Figure 5:
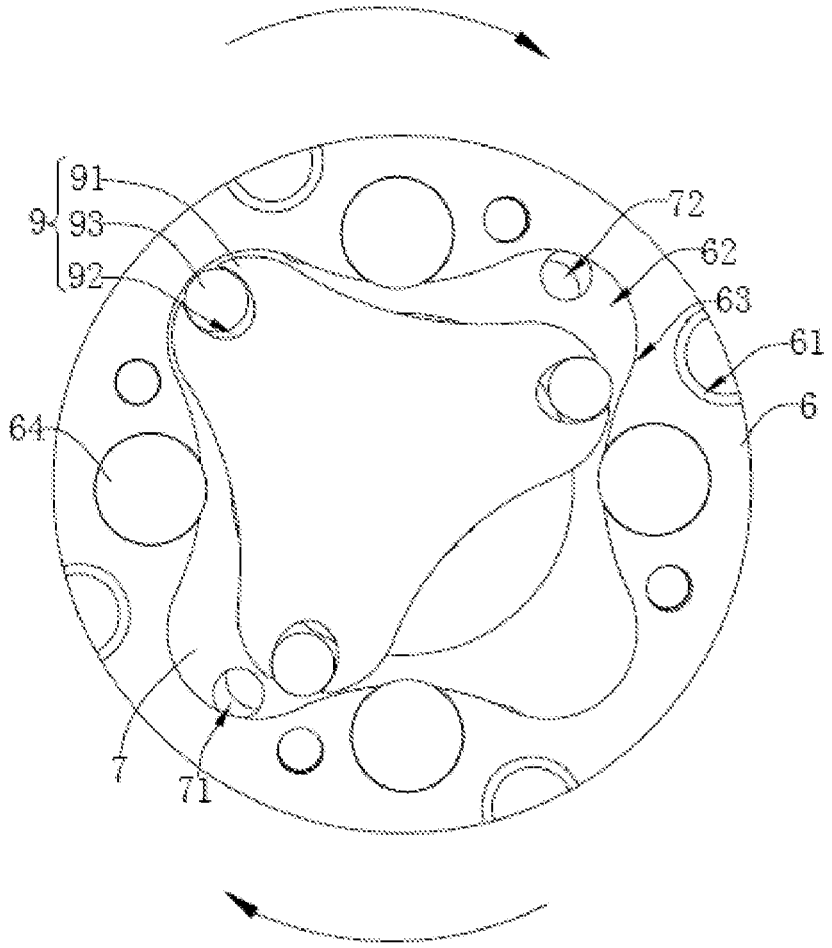
FIG. 5 is a top view showing a positional and matching relationship between the stator and the rotor.

Referring to FIG. 5, the inside of the stator 6 is provided with N grooves 62 that extend through the stator 6 along the axial direction of the outer tube 1. The chamber walls of the N grooves 62 are connected end to end to form an inner contour surface 63. The rotor 9 is formed with N−1 rotating heads 91 provided along the axial direction of the outer tube 1. A working chamber is formed among the adjacent rotating heads 91 and the inner contour surface 63, the partition plate 5 and the flow distribution disc 7. In the present application, four grooves 62, three rotating heads 91 and three working chambers are taken as an example for illustration.

Each rotating head 91 is provided with an elliptical embedding slot 92 that extends through the rotating head 91 along the axial direction of the outer tube 1. A rotor copper rod 93 with a circular cross section is provided in the embedding slot 92. One side of the embedding slot 92 is provided with a notch of the same length as the embedding slot, and the width of the notch is slightly smaller than the diameter of the rotor copper rod 93. Due to the structural design between the elliptical embedding slot 92 and the cylindrical rotor copper rod 93, during the rotation of the rotor 9, the rotor copper rod 93 can protrude a part of the embedding slot 92 through the notch under the centrifugal action, so as to contact the inner contour surface 63. At the same time, under the action of the high-pressure water flow, the rotor copper rod 93 is pressed against the inner contour surface 63. With the rotor copper rod 93, the traditional sliding friction between the rotor 9 and the stator 6 is converted into rolling friction, which greatly reduces the friction resistance of the traditional stator and rotor mating surface, reduces the kinetic energy loss, and improves the service life. At the same time, when the liquid contains impurities, the rotor copper rod 93 can be retracted into the embedding slot 92 under the action of the squeezing force, so that the impurities can pass through to prevent the rotor 9 from jamming and ensure the continuous normal operation of the downhole motor.

In addition, in order to further reduce the frictional resistance between the stator 6 and the rotor 9, a slot is provided at the position of the stator 6 between the adjacent grooves 62, and a rotatable stator copper rod 64 is assembled in the slot so as to form an intermittent rolling engagement with the rotor 9 during the rotation process.

Figure 6:
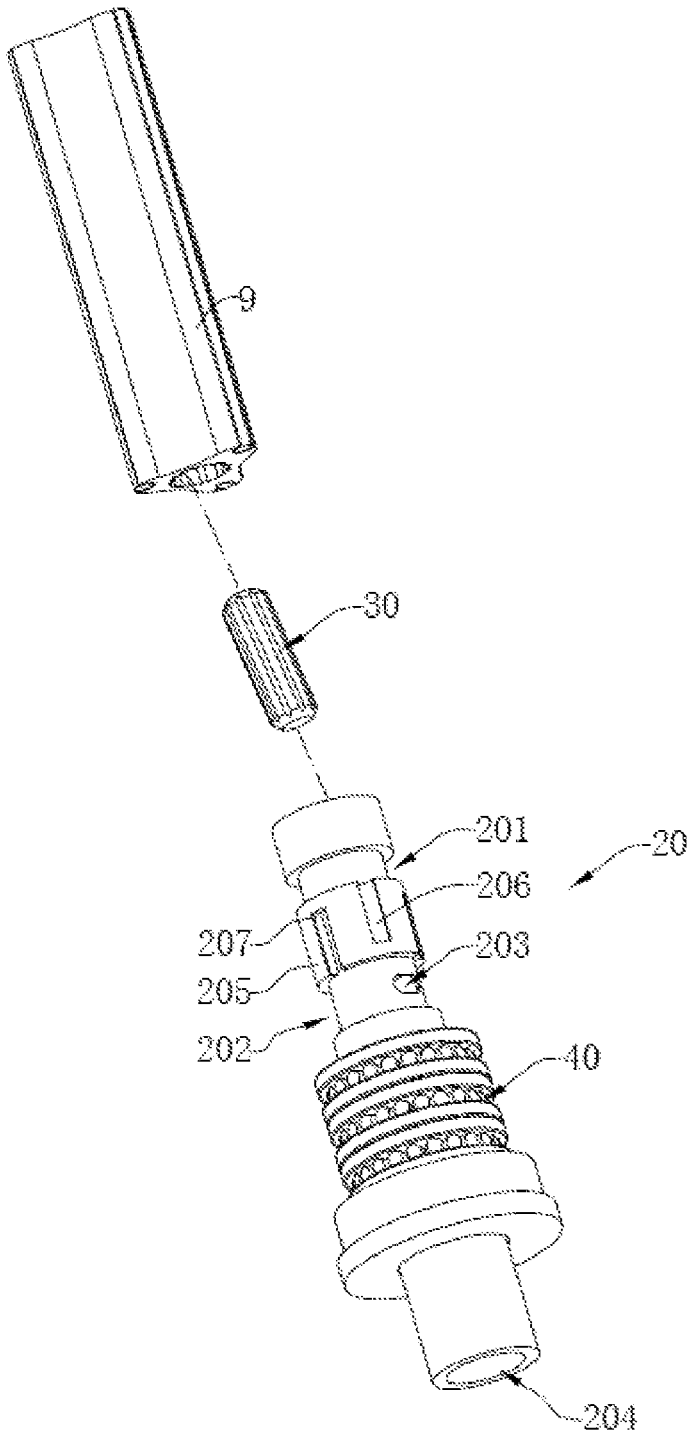
FIG. 6 is an exploded schematic diagram showing a transmission connection between the rotor and the flow distribution shaft through a cardan shaft.

Referring to FIGS. 3 and 6, the flow guide mechanism comprises a flow distribution cylinder 10 provided within the outer tube 1 and communicated with the flow distribution disc 7, and a flow distribution shaft 20 rotatably provided in the flow distribution cylinder 10 through a bearing 40 to communicate the flow passage 61 with the flow distribution cylinder 10. The flow distribution shaft 20 is gaplessly and rotatably fitted with the flow distribution cylinder 10, and the flow distribution cylinder 10 is supported on the base 8.

A cardan shaft 30 for transmission is provided between the flow distribution shaft 20 and the rotor 9, a spline is provided on the outer side wall of the cardan shaft 30, and the opposite ends of the flow distribution shaft 20 and of the rotor 9 is provided with a spline slot that can cooperate with the spline. During the rotation of the rotor 9, the rotor 9 drives the flow distribution shaft 20 to rotate synchronously through the cardan shaft 30. At the same time, the end of the flow distribution shaft 20 away from the spline slot extends through the base 8 and to the outside of the outer tube 1 for connection with other load mechanisms.

Referring to FIG. 6, the outer side wall of the flow distribution shaft 20 is provided with a first ring slot 201 and a second ring slot 202. The second ring slot 202 is provided with a liquid discharge port 203 radially extending through the flow distribution shaft 20. The end of the flow distribution shaft 20 away from the spline slot is provided inwardly with a liquid discharge chamber 204 communicating with the liquid discharge port 203. A flow distribution ring 205 is formed between the first ring slot 201 and the second ring slot 202, and the flow distribution ring 205 is provided with a plurality of liquid inlet slots 206 and liquid outlet slots 207 that are equidistantly distributed on a circumference and provided at intervals. The liquid inlet slot 206 is communicated with the first ring slot 201, and the liquid outlet slot 207 is communicated with the second ring slot 202. In the present application, the liquid inlet slots 206 and the liquid outlet slots 207 both are three.

Figure 7:
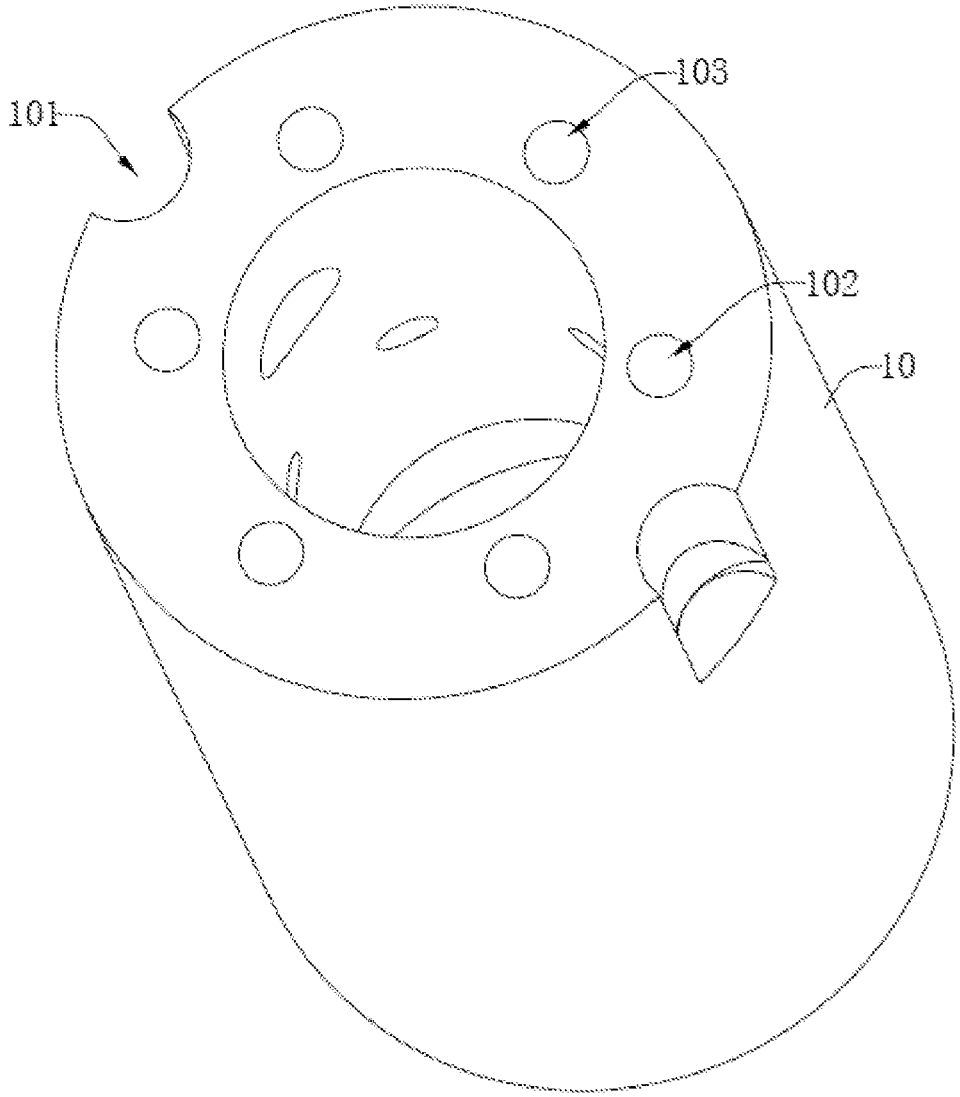
FIG. 7 is a schematic diagram showing the specific structure of the flow distribution cylinder.
Figure 8:
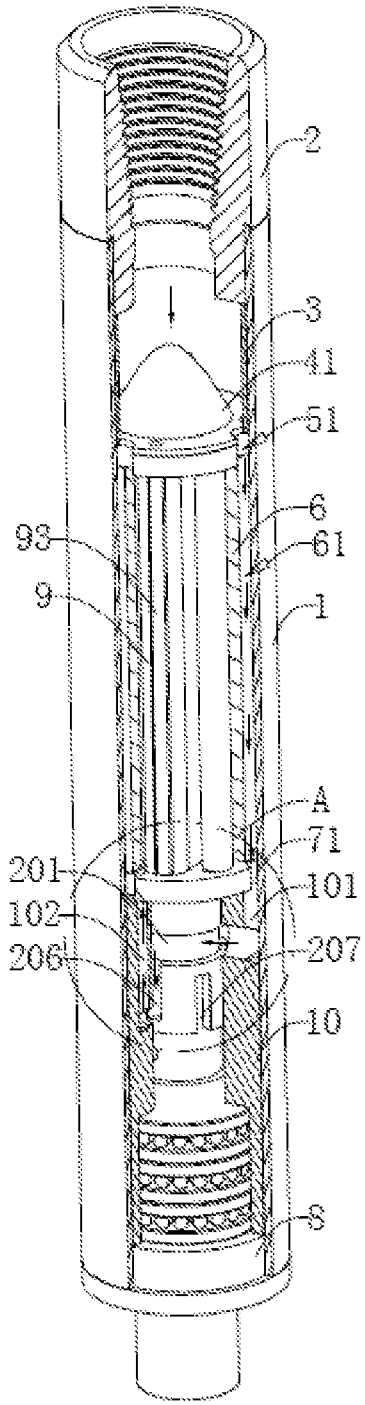
FIG. 8 is a cross-sectional view showing how high-pressure liquid enters a working chamber.
Figure 9:
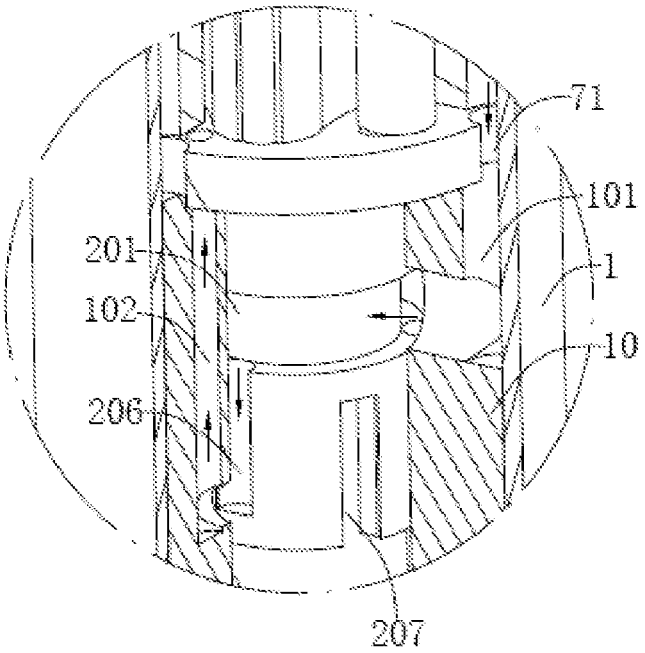
FIG. 9 is a partial enlarged schematic diagram of part A in FIG. 8.
Figure 10:
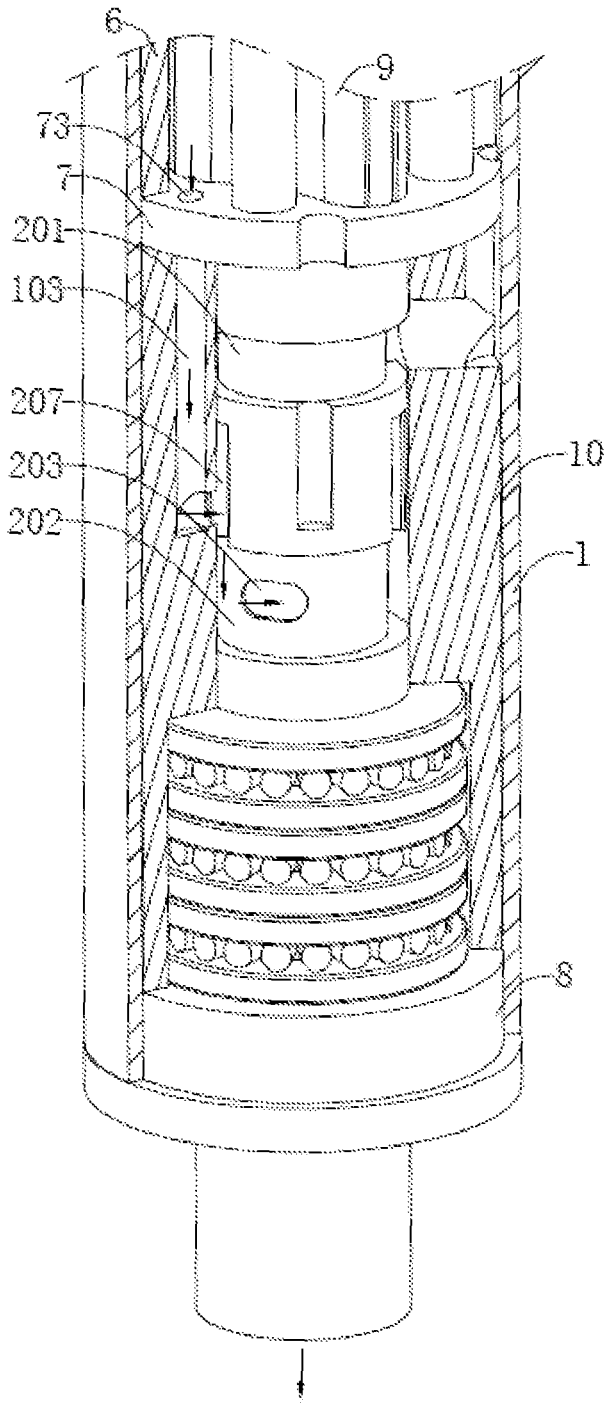
FIG. 10 is a cross-sectional view showing how high-pressure liquid is discharged from the working chamber.

Referring to FIGS. 7, 8 and 9, a fourth relief slot 101 communicating with the first ring slot 201 is provided at the position of the flow distribution cylinder 10 corresponding to the third relief slot 71. a plurality of liquid inlet channels 102 and liquid outlet channels 103 that are equidistantly distributed on a circumference and provided at intervals are provided inwardly from an end of the flow distribution cylinder 10 close to the flow distribution disc 7 along the axial direction. The liquid inlet channel 102 is communicated with the liquid inlet slot 206. Referring to FIG. 10, the liquid outlet channel 103 is communicated with the liquid outlet slot 207. In the present application, the liquid inlet channels 102 and liquid outlet channels 103 both are three.

Referring to FIGS. 5 and 8, the flow distribution disc 7 is provided with a liquid inlet 72 and a liquid outlet 73 corresponding to different working chambers. The working chamber communicating with the liquid inlet 72 is a high-pressure chamber, and the working chamber communicating with the liquid outlet 73 is a low-pressure chamber, and the remaining working chamber is a stable chamber. The liquid inlet 72 can be communicated with any liquid inlet channel 102 to supply liquid into the high-pressure chamber. Referring to FIGS. 5 and 10, the liquid outlet 73 can be communicated with any liquid outlet channel 103 to discharge the liquid in the low-pressure chamber.

Figure 11:
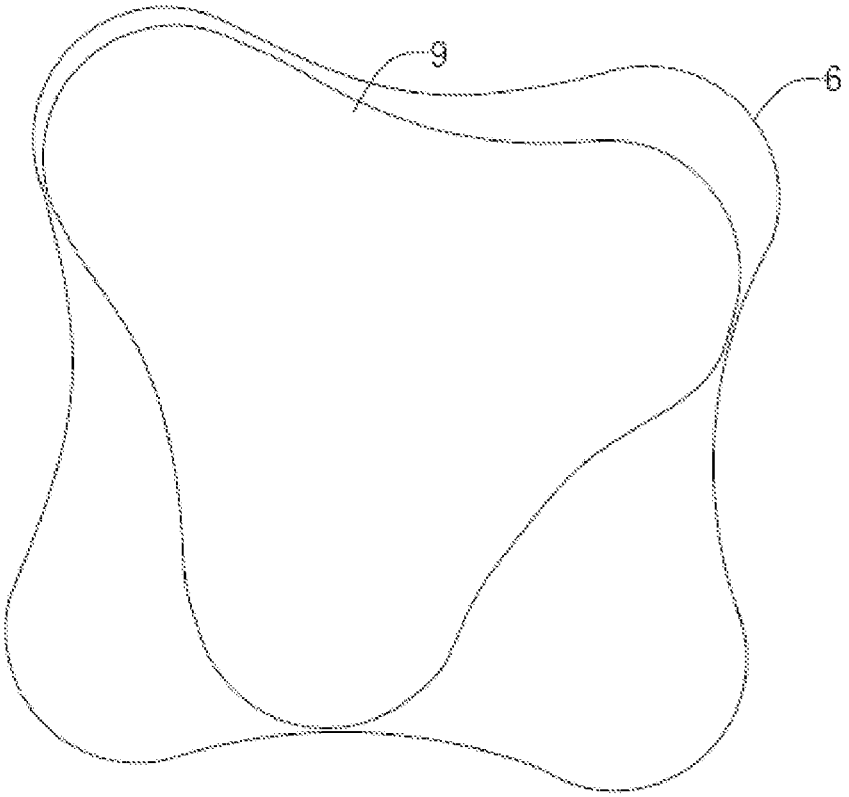
FIG. 11 is a schematic diagram showing the initial state of the rotor in the stator.
Figure 12:
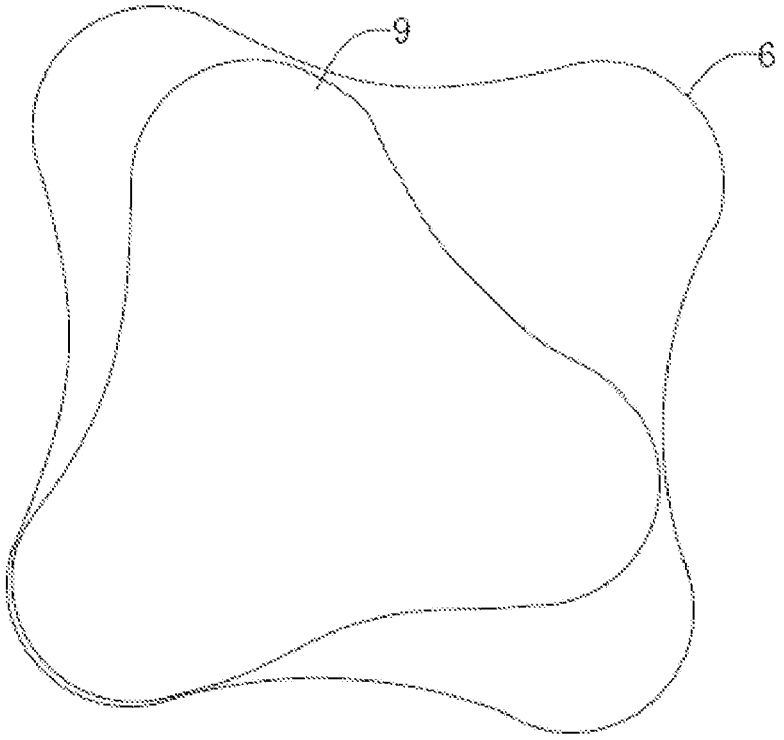
FIG. 12 is a schematic diagram showing that the rotor rotates to a first state.
Figure 13:
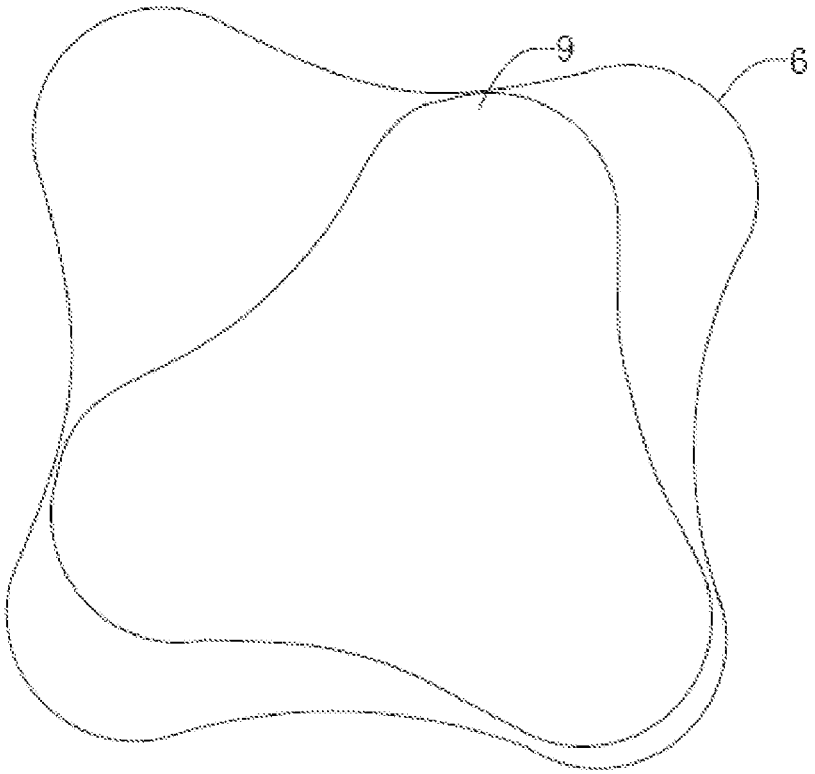
FIG. 13 is a schematic diagram showing that the rotor rotates to a second state.
Figure 14:
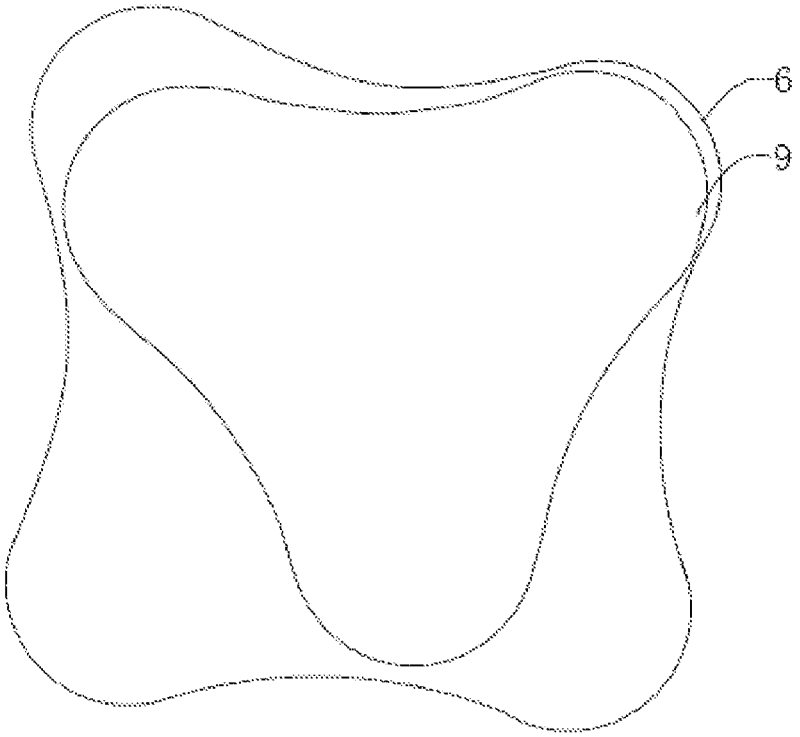
FIG. 14 is a schematic diagram showing that the rotor rotates to a third state.
Figure 15:
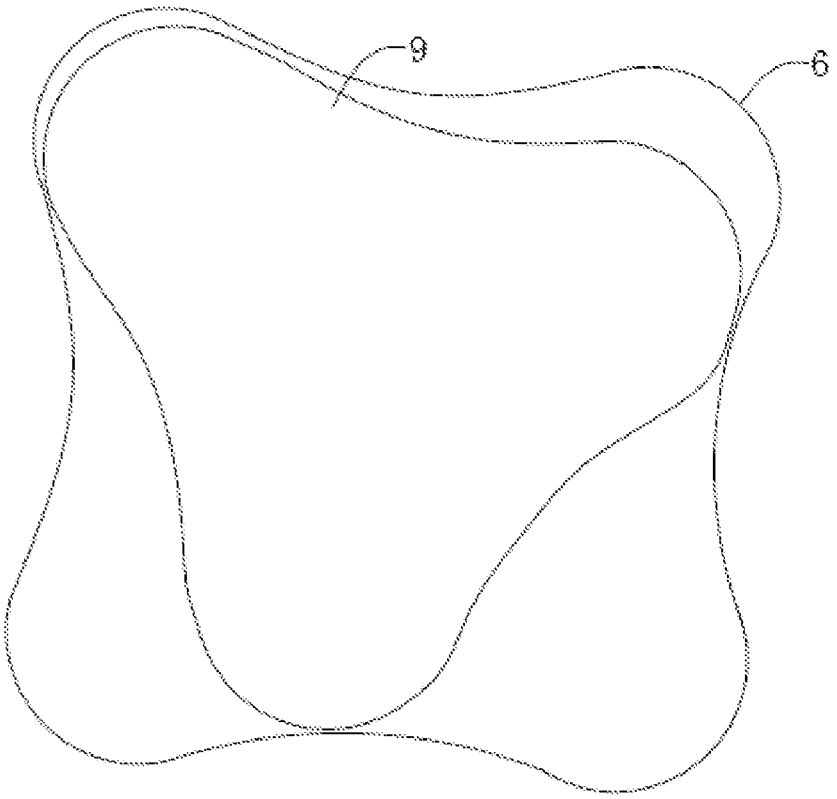
FIG. 15 is a schematic diagram showing that the rotor returns to the initial state after one revolution.

The implementation principle of the embodiment of the present application is: during operation, the high-pressure liquid is injected from the joint 2 and after being divided by the cone 41, it sequentially passes through the first relief slot 42, the second relief slot 51, the flow passage 61, and the third relief slot 71 and the fourth relief slot 101 and enter the first ring slot 201. Since the inner wall of the flow distribution shaft 20 matches the outer wall of the flow distribution cylinder 10, the high-pressure liquid can only flow into the three liquid inlet slots 206 and then is injected into the high-pressure chamber formed between the inner curved surface of the stator 6 and the outer curved surface of the rotor 9 through the liquid inlet slot 206 communicated with the liquid inlet 72 on the flow distribution disc 7. Since the rotor 9 and the stator 6 are placed eccentrically, with the rotor 9 as the center, in the high pressure chamber, the force area of the high pressure water on the right side of the outer surface of the rotor 9 is greater than the force area of the high pressure water on the left side, that is, the right side of the rotor 9 bears high pressure water power than the left side. As a result, the high-pressure chamber gradually expands and drives the rotor 9 to rotate at a certain angle (60°). In this process, the rotor 9 drives the flow distribution shaft 20 to rotate through the cardan shaft 30. When the liquid outlet 73 is communicated with any liquid outlet channel 103, the liquid enters the second ring slot 202 and is sequentially discharged from the liquid discharge port 203 and the liquid discharge chamber 204, and so on to complete the continuous rotation of the motor. In the process of the rotor 9 making one revolution, the changing state of each chamber is shown in FIG. 11 to FIG. 15, where FIG. 11 is the initial state; while the high-pressure liquid in the other two liquid inlet slots 206 impacts on the flow distribution disc 7 to exert the flow distribution disc 7 an upward supporting force, offsetting part of the impact force at the water injection end, thereby reducing the axial load acting on the bearing 40 and improving the service life of the downhole motor.

The above are the preferred embodiments of the present application, and the scope of protection of the present application is not limited accordingly. Therefore, all equivalent changes made in accordance with the structure, shape and principle of the present application shall be covered by the scope of protection of the present application.

What is claimed is:

1. A full-metal anti-high temperature cycloid downhole motor, comprising an outer tube (1), a stator (6) fixedly mounted in the outer tube (1), a rotor (9) provided in the stator (6) and having the same height as the stator (6), a partition plate (5) and a flow distribution disc (7) respectively fixed to two ends of the stator (6), and a flow guide mechanism located at a side of the flow distribution disc (7) away from the stator (6), wherein the flow guide mechanism cooperates with the flow distribution disc (7) to perform a flow distribution to drive the rotor (9) to rotate in the stator (6);

an inside of the stator (6) is provided with N grooves (62) distributed equidistantly on a circumference thereof and extending through the stator (6) along an axial direction of the outer tube (1), inner side walls of the N grooves (62) are connected together to form an annular inner contour surface (63), wherein N is a natural number greater than 1;

the rotor (9) is formed with N−1 rotating heads (91) provided along the axial direction of the outer tube (1), a working chamber is formed among the adjacent rotating heads (91) and the inner contour surface (63), the partition plate (5) and the flow distribution disc (7), and each rotating head (91) is provided with an embedding slot (92) that extends through the rotating head (91) along the axial direction of the outer tube (1), one side of the embedding slot (92) is provided with a notch of the same length as the embedding slot, a rotor copper rod (93) that is in rolling engagement with the inner contour surface (63) through the notch is provided in the embedding slot (92), and there is a changing gap between an outer wall of the rotor copper rod (93) and an inner wall of the embedding slot (92).

2. The full-metal anti-high temperature cycloid downhole motor according to claim 1, wherein a stator copper rod (64) in rolling contact with the rotor (9) is rotatably embedded in a position of the stator (6) between adjacent grooves (62).

3. The full-metal anti-high temperature cycloid downhole motor according to claim 1, wherein an outer side wall of the stator (6) is attached to an inner side wall of the outer tube (1), and at least one flow passage (61) extending axially along the outer tube (1) and communicating with the flow guide mechanism is provided on the outer side wall of the stator (6); a second relief slot (51) is provided at a position of the partition plate (5) corresponding to the flow passage (61), a third relief slot (71) is provided at a position of the flow distribution disc (7) corresponding to the flow passage (61).

4. The full-metal anti-high temperature cycloid downhole motor according to claim 3, wherein a water diversion cover plate (4) is fixed on a side of the partition plate (5) away from the stator (6), a first relief slot (42) is provided at a position of the water diversion cover plate (4) corresponding to the flow passage (61); a cone (41) is integrally formed on the water diversion cover plate (4), a bottom surface of the cone (41) is smaller than a surface of the water diversion cover plate (4), and an apex of the cone (41) faces a water inlet end.

5. The full-metal anti-high temperature cycloid downhole motor according to claim 4, wherein the flow guide mechanism comprises a flow distribution cylinder (10) provided within the outer tube (1) and communicated with the flow distribution disc (7), and a flow distribution shaft (20) rotatably connected within the flow distribution cylinder (10) to communicate the flow passage (61) with the flow distribution cylinder (10), and the flow distribution shaft (20) is gaplessly and rotatably fitted with the flow distribution cylinder (10);

a cardan shaft (30) for transmission is provided between the flow distribution shaft (20) and the rotor (9), a spline is provided on an outer side wall of the cardan shaft (30), and opposite ends of the flow distribution shaft (20) and the rotor (9) are provided with a spline slot that can cooperate with the spline.

6. The full-metal anti-high temperature cycloid downhole motor according to claim 5, wherein the flow distribution shaft (20) is rotatably supported within the flow distribution cylinder (10) through a bearing (40).

7. The full-metal anti-high temperature cycloid downhole motor according to claim 5, wherein an outer side wall of the flow distribution shaft (20) is provided with a first ring slot (201) and a second ring slot (202), the second ring slot (202) is provided with a liquid discharge port (203) radially extending through the flow distribution shaft (20), and an end of the flow distribution shaft (20) away from the spline slot is provided inwardly with a liquid discharge chamber (204) communicating with the liquid discharge port (203);

a flow distribution ring (205) is formed between the first ring slot (201) and the second ring slot (202), and the flow distribution ring (205) is provided with a plurality of liquid inlet slots (206) and liquid outlet slots (207) that are equidistantly distributed on a circumference and provided at intervals; the liquid inlet slot (206) is communicated with the first ring slot (201), and the liquid outlet slot (207) is communicated with the second ring slot (202);

a fourth relief slot (101) communicating with the first ring slot (201) is provided at a position of the flow distribution cylinder (10) corresponding to the third relief slot (71), a plurality of liquid inlet channels (102) and liquid outlet channels (103) that are equidistantly distributed on a circumference and provided at intervals are provided inwardly from an end of the flow distribution cylinder (10) close to the flow distribution disc (7) along the axial direction, and the liquid inlet channel (102) is communicated with the liquid inlet slot (206), and the liquid outlet channel (103) is communicated with the liquid outlet slot (207);

the flow distribution disc (7) is provided with a liquid inlet (72) that is communicated with any liquid inlet channel (102) to supply liquid to the corresponding working chamber, and a liquid outlet (73) that is communicated with any liquid outlet channel (103) to discharge the liquid in the corresponding working chamber, and the liquid inlet (72) and the liquid outlet (73) correspond to different working chambers.

8. The full-metal anti-high temperature cycloid downhole motor according to claim 5, wherein an end of the outer tube (1) away from the partition plate (5) is provided with a base (10) for supporting the flow distribution cylinder (10), the end of the flow distribution shaft (20) away from the spline slot extends through the base (8) and to an outside of the outer tube (1), and an end of the outer tube (1) close to the partition plate (5) is provided with a joint (2) to press the stator (6) against the flow distribution cylinder (10).

9. The full-metal anti-high temperature cycloid downhole motor according to claim 8, wherein the joint (2) comprises an assembly section (21) and a connecting section (22) that are integrally formed, and the assembly section (21) presses the stator (6) against the flow guide mechanism by being fixedly connected with an inner wall of the outer tube (1); and an inner wall of the connecting section (22) is provided with internal threads.

* * * * *